US012616866B2

(12) United States Patent
Hong

(10) Patent No.: US 12,616,866 B2
(45) Date of Patent: May 5, 2026

(54) WEIGHT-VISUALIZED DUMBBELL

(71) Applicant: Ningbo Haishu Longhao Fitness Appliances Co., Ltd., Ningbo (CN)

(72) Inventor: Guonian Hong, Ningbo (CN)

(73) Assignee: Ningbo Haishu Longhao Fitness Appliances Co., Ltd., Ningbo (CN)

( * ) Notice: Subject to any disclaimer, the term of this patent is extended or adjusted under 35 U.S.C. 154(b) by 99 days.

(21) Appl. No.: 18/784,960

(22) Filed: Jul. 26, 2024

(65) Prior Publication Data

US 2025/0090889 A1 Mar. 20, 2025

(51) Int. Cl.
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/0726; A63B 21/0728; A63B 21/075; A63B 2220/17
See application file for complete search history.

(56) References Cited

U.S. PATENT DOCUMENTS

| | | | | |
|---|---|---|---|---|
| 7,491,156 | B1 * | 2/2009 | GaoYong | A63B 21/0724 482/106 |
| D751,941 | S * | 3/2016 | Vaughan | D11/81 |
| 10,022,583 | B2 * | 7/2018 | Wang | A63B 21/0726 |
| 11,285,354 | B1 * | 3/2022 | Tseng | A63B 21/0726 |
| 12,364,897 | B2 * | 7/2025 | Zhang | A63B 21/0728 |
| 2015/0360073 | A1 * | 12/2015 | Moran | A63B 21/075 |
| 2016/0166873 | A1 * | 6/2016 | Liu | A63B 21/0726 482/107 |
| 2023/0414987 | A1 * | 12/2023 | Flom | A63B 21/072 |

* cited by examiner

*Primary Examiner* — Andrew M Kobylarz
(74) *Attorney, Agent, or Firm* — Bayramoglu Law Offices LLC

(57) ABSTRACT

A weight-visualized dumbbell includes two weight plate sets and a grab handle assembly configured to suspend and grip the weight plate sets, where the grab handle assembly includes a handle tube, an end cover assembly connected to the handle tube, and a plate selection mechanism connected to the handle tube and rotating synchronously with the handle tube; the plate selection mechanism is provided with a plurality of gears; when the plate selection mechanism rotates to different gears, different numbers of weight plates are fixedly suspended and gripped; a display mechanism is provided in the end cover assembly; the display mechanism rotates synchronously with the handle tube; the display mechanism is provided with labels that are in one-to-one correspondence with the gears of the plate selection mechanism; and a display opening configured for the label to be exposed is formed in the end cover assembly.

9 Claims, 6 Drawing Sheets

WEIGHT-VISUALIZED DUMBBELL

CROSS REFERENCE TO THE RELATED APPLICATIONS

This application is based upon and claims priority to Chinese Patent Application No. 202322549894.7, filed on Sep. 19, 2023, the entire contents of which are incorporated herein by reference.

TECHNICAL FIELD

The present disclosure relates to the technical field of fitness equipment, and in particular to a weight-visualized dumbbell.

BACKGROUND

As a fitness equipment favored by fitness enthusiasts, the dumbbell can be used to train strength of a user's arms. The dumbbell can be placed at home for its small size, such that fitness enthusiasts can take exercises without going to fitness rooms.

The dumbbell typically includes a plurality of weight plates, a grab handle assembly configured for the weight plates to be mounted, and a base configured for the weight plates to be placed. The grab handle assembly includes a handle tube, a plate selection mechanism provided on the handle tube, an internal end cover, and an external end cover. For the existing dumbbell in markets, gears can be shifted by rotating the handle tube on the grab handle assembly, thereby adjusting the number of weight plates on the grab handle assembly. Labels indicating the number or the weight and in one-to-one correspondence with the gears are further marked on the existing dumbbell, such that the user knows the number or the weight of the dumbbell at the present gear when adjusting the weight plates.

However, the labels of the existing dumbbell are directly marked on the outer sidewall of the internal end cover or the peripheral surface of the internal end cover. When the dumbbell is used, the labels marked on the outer sidewall of the internal end cover are worn easily. After long-time use, the labels become unclear to affect the reading experience. For the labels marked on the peripheral surface of the internal end cover, the protective cover is provided for the peripheral surface of the internal end cover to prevent the wear. Nevertheless, this structure increases the overall size of the internal end cover to some extent.

SUMMARY

In order to solve the problem that labels marked on an outer sidewall of an internal end cover are worn easily or a protective cover is provided for the labels marked on a peripheral surface of the internal end cover to increase a size of a dumbbell, the present disclosure provides a weight-visualized dumbbell.

The preset application employs the following technical solutions to realize the weight-visualized dumbbell.

A weight-visualized dumbbell includes two weight plate sets and a grab handle assembly configured to suspend and grip the weight plate sets, where the grab handle assembly includes a handle tube, an end cover assembly connected to the handle tube, and a plate selection mechanism connected to the handle tube and rotating synchronously with the handle tube; the plate selection mechanism is provided with a plurality of gears that are driven by the handle tube to rotate relative to the weight plate sets; when the plate selection mechanism rotates to different gears, different numbers of weight plates are fixedly suspended and gripped; a display mechanism is provided in the end cover assembly; the display mechanism rotates synchronously with the handle tube; the display mechanism is provided with labels that are in one-to-one correspondence with the gears of the plate selection mechanism and are each configured to display a weight of the dumbbell at a present gear; and a display opening configured for the label to be exposed is formed in the end cover assembly.

According to the above technical solution, the labels are in one-to-one correspondence with the gears of the plate selection mechanism. When the plate selection mechanism is shifted to some gear by rotating the handle tube, the label of the display mechanism can display a value on the weight of the weight plates at the present gear. The label can be directly observed by a user through the display opening, thereby being simple and convenient. Since the display mechanism is provided in the end cover assembly, the label is protected by the end cover assembly, and the label is not damaged easily. Meanwhile, there is no need to additionally provide a protective cover on the end cover assembly to protect the display mechanism, thereby reducing a size of the internal end cover.

Optionally, the display mechanism includes a locating disc coaxial with the handle tube and configured to rotate synchronously with the handle tube, and a display disc provided on the end cover assembly and cooperating with the locating disc; a plurality of locating recesses are uniformly formed in a circumferential direction of the locating disc; a driven toothed portion cooperating with the locating recesses is provided in a circumferential direction of the display disc; each of the locating recesses corresponds to one of the gears of the plate selection mechanism; and the label is located on the display disc.

According to the above technical solution, when the gear of the dumbbell is shifted by rotating the handle tube, the locating disc can rotate synchronously with the handle tube. Meanwhile, the locating disc can drive the display disc to rotate, such that the value of the label can change in response to the gear. The above structure is simple. The locating recesses are engaged with the driven toothed portion, such that the display disc can limit the locating disc to some extent. After the gear of the dumbbell is shifted, the handle tube is not prone to rotation.

Optionally, a number of the locating recesses doubles a number of the gears of the plate selection mechanism.

According to the above technical solution, when the dumbbell is placed on a bearing surface, the handle tube cannot be rotated 360° by the user without moving the dumbbell. When the number of the locating recesses doubles the number of the gears of the plate selection mechanism, the gears of the plate selection mechanism each can be shifted once by rotating the handle tube for a half of a circumference. This facilitates adjustment of the user on the gear of the dumbbell.

Optionally, the weight-visualized dumbbell further includes a base configured for the weight plate sets to be placed; the base is provided with a limiting member; a stop mechanism is further movably provided in the end cover assembly; and the stop mechanism is configured to lock rotation of the locating disc or unlock the rotation of the locating disc through the limiting member.

According to the above technical solution, when the dumbbell is lifted by the user, the limiting member can lock the locating disc and the plate selection mechanism. Consequently, the locating disc and the plate selection mechanism are not prone to rotation, and the weight plates suspended and gripped on the dumbbell do not fall off from the grab handle assembly easily, thereby preventing hurt to the user. Only when the grab handle assembly is placed on the base, the grab handle assembly can rotate, and the gear can be shifted, thereby being safe.

Optionally, stop grooves in one-to-one correspondence with the locating recesses are formed in the circumferential direction of the locating disc; and the stop mechanism includes a stop member slidably provided in the end cover assembly and cooperating with the stop groove in a clamping manner, and a stop spring configured to drive the stop member to always tend to be clamped into the stop groove.

According to the above technical solution, when the grab handle assembly of the dumbbell is taken up from the base, the stop member driven by the stop spring can be clamped into the stop groove of the locating disc again, and the stop member under an elasticity of the stop spring does not fall out from the stop groove easily, thereby being safe.

Optionally, the display mechanism further includes a locking assembly provided in the end cover assembly and cooperating with the locating recess; and the locking assembly is configured to drive the plate selection mechanism to always tend to rotate to one gear.

According to the above technical solution, when the gear of the dumbbell is shifted by the user, the plate selection mechanism driven by the locking assembly can be always shifted to one gear, and a condition in which only a half of the gear is shifted and the weight plate falls off from the grab handle assembly does not occur easily.

Optionally, the locking assembly includes a clamping member slidably provided in the end cover assembly and a locking spring configured to drive the clamping member to always tend to be clamped into the locating recess.

According to the above technical solution, the structure of the locking assembly is specifically disclosed. When the gear of the dumbbell is not shifted in place, and the clamping member is located between two adjacent locating recesses, the clamping member under an elasticity of the locking spring can drive the locating disc to restore the gear automatically, and the clamping member is automatically clamped at an adjacent gear. This reduces a probability that the dumbbell is clamped between two gears, and can further reduce a probability that the weight plate falls off to pose a danger to the user in a dumbbell lifting process because the gear is not shifted in place.

Optionally, the end cover assembly includes an external end cover fixedly provided at an end of the handle tube and an internal end cover rotatably provided on the handle tube; the plate selection mechanism is located between the internal end cover and the external end cover; the display mechanism is provided in the internal end cover; and the display opening penetrates into the internal end cover from an outside of the internal end cover.

According to the above technical solution, the display mechanism is provided in the internal end cover, and only one display opening directly facing the label is formed for a user to read, such that the overall structure of the dumbbell is compact, and the display mechanism in the internal end cover is not damaged easily.

Optionally, an anti-rotating beam is connected between the internal end cover and the external end cover; and an anti-rotating clamping groove configured for the anti-rotating beam to be clamped into is formed in each of the weight plates.

According to the above technical solution, after the weight plate is suspended and gripped on the grab handle assembly, the weight plate is limited by the anti-rotating beam, and the weight plate on the grab handle assembly is not prone to rotation. This reduces a probability that the weight plate rotates to fall off from the grab handle assembly when the dumbbell is used by the user, and improves safety of the dumbbell in use.

Optionally, the plate selection mechanism includes a plurality of fixing pieces; each of the fixing pieces is a centrosymmetric cam structure; a fixing groove configured for the fixing piece to be rotatably clamped is formed in each of the weight plates; and an access groove penetrating into the fixing groove and configured for the fixing piece to be vertically inserted into is further formed in the weight plate.

According to the above technical solution, the fixing piece is rotatably clamped onto the weight plate, such that the weight plate can be suspended and gripped on the grab handle assembly. Because of the symmetric structure of the fixing piece, the fixing piece can be clamped onto the weight plate clockwise or counterclockwise, thereby being convenient.

In conclusion, the present disclosure achieves at least one of the following beneficial technical effects.

1. According to the weight-visualized dumbbell, since the display mechanism is provided in the end cover assembly, the label can be protected by the end cover assembly, and the label is not damaged easily. Meanwhile, there is no need to additionally provide a protective cover on the end cover assembly for the display mechanism, thereby reducing a size of the internal end cover.

2. With the locking assembly, after the dumbbell is shifted to some gear, the handle tube is not prone to rotation. When the gear of the dumbbell is not shifted in place, the locking assembly can drive the dumbbell to restore the gear, and the dumbbell is shifted to an adjacent gear again. This reduces a probability that the weight plate falls off because the gear is not shifted in place, and improves safety of the dumbbell in use.

3. With the anti-rotating beam, the weight plate can be clamped into the anti-rotating beam after suspended and gripped on the grab handle assembly. When the dumbbell is used by the user, the weight plate is not prone to rotation on the grab handle assembly, thereby reducing a probability that the weight plate falls off from the grab handle assembly to hurt the user.

In the figures: 1: weight plate set, 11: weight plate, 2: grab handle assembly, 21: handle tube, 211: grip segment, 212: mounting segment, 22: end cover assembly, 221: internal end cover, 2211: display opening, 2212: slideway, 2213: rotating shaft, 2214: sliding groove, 222: external end cover, 2221: annular sliding groove, 223: anti-rotating beam, 2231: slider, 23: plate selection mechanism, 231: fixing piece, 2311: fixing groove, 2312: access groove, 2313: anti-rotating clamping groove, 24: display mechanism, 241: locating disc, 2411: locating recess, 2412: stop groove, 242: display disc, 2421: toothed disc portion, 24211: driven toothed portion, 2422: display portion, 24221: label, 243: locking assembly, 2431: clamping member, 2432: locking spring, 25: stop assembly, 251: stop member, 252: stop spring, 3: base, 31: placement groove, and 32: limiting member.

DETAILED DESCRIPTION OF THE EMBODIMENTS

The present disclosure will be further described in detail below with reference to FIGS. 1-6.

An embodiment of the present disclosure provides a weight-visualized dumbbell.

Figure 1:
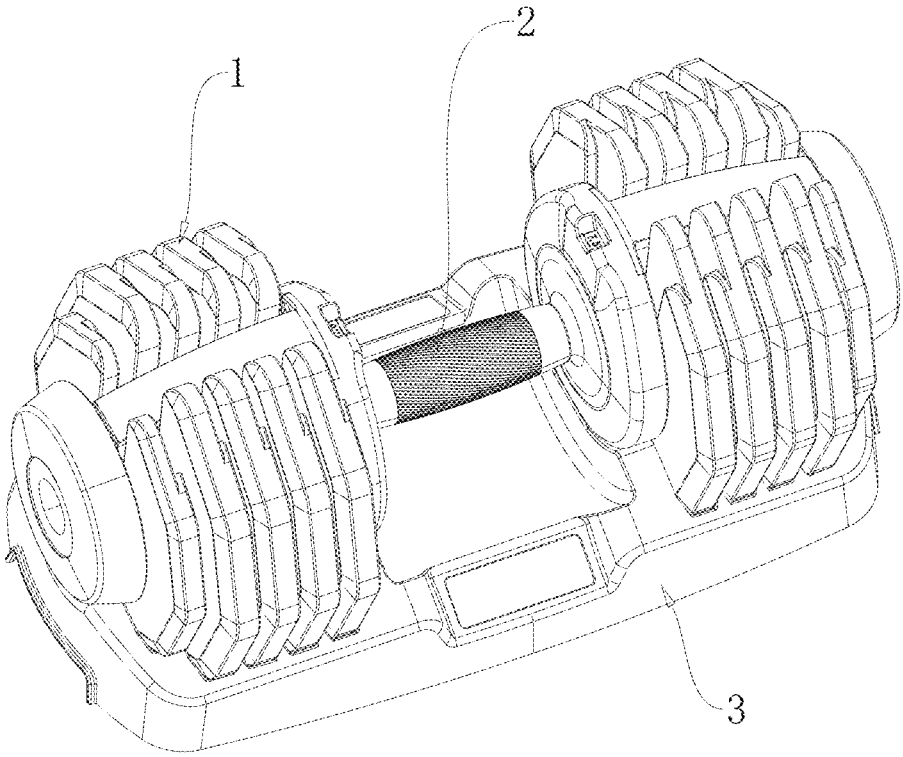
FIG. 1 is an overall schematic structural view of a weight-visualized dumbbell according to an embodiment of the present disclosure.
Figure 2:
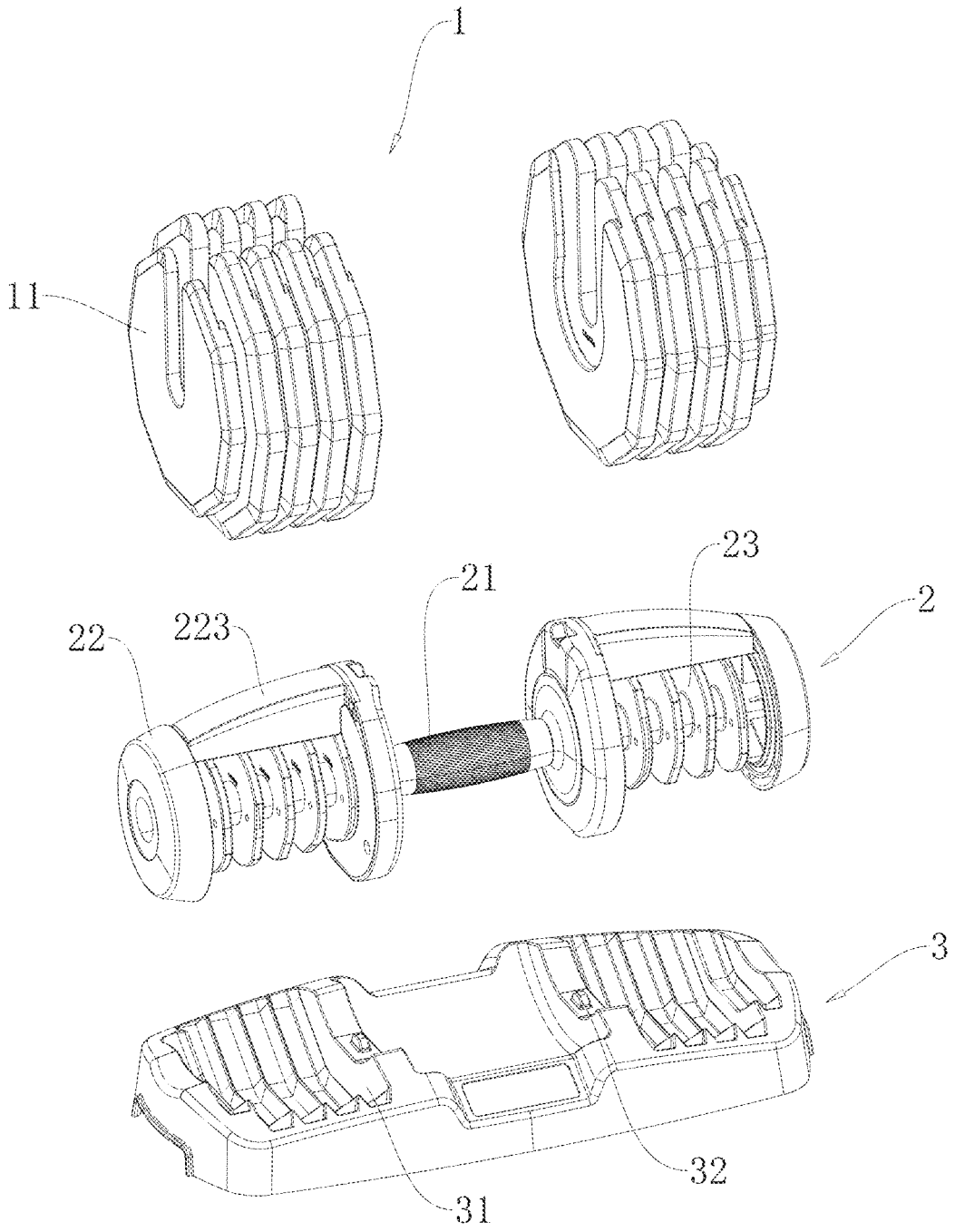
FIG. 2 is an exploded view of a weight-visualized dumbbell according to an embodiment of the present disclosure.

Referring to FIG. 1 and FIG. 2, the weight-visualized dumbbell includes two weight plate sets 1, grab handle assembly 2, and base 3. The base 3 is configured for the weight plate sets 1 to be placed. The grab handle assembly 2 is configured to suspend and grip the weight plate sets 1. The weight plate sets 1 can be symmetrically provided at two ends of the grab handle assembly 2. In the embodiment, the weight plate sets 1 each include five weight plates 11. There are one small weight plate 11 and four big weight plates 11.

Figure 3:
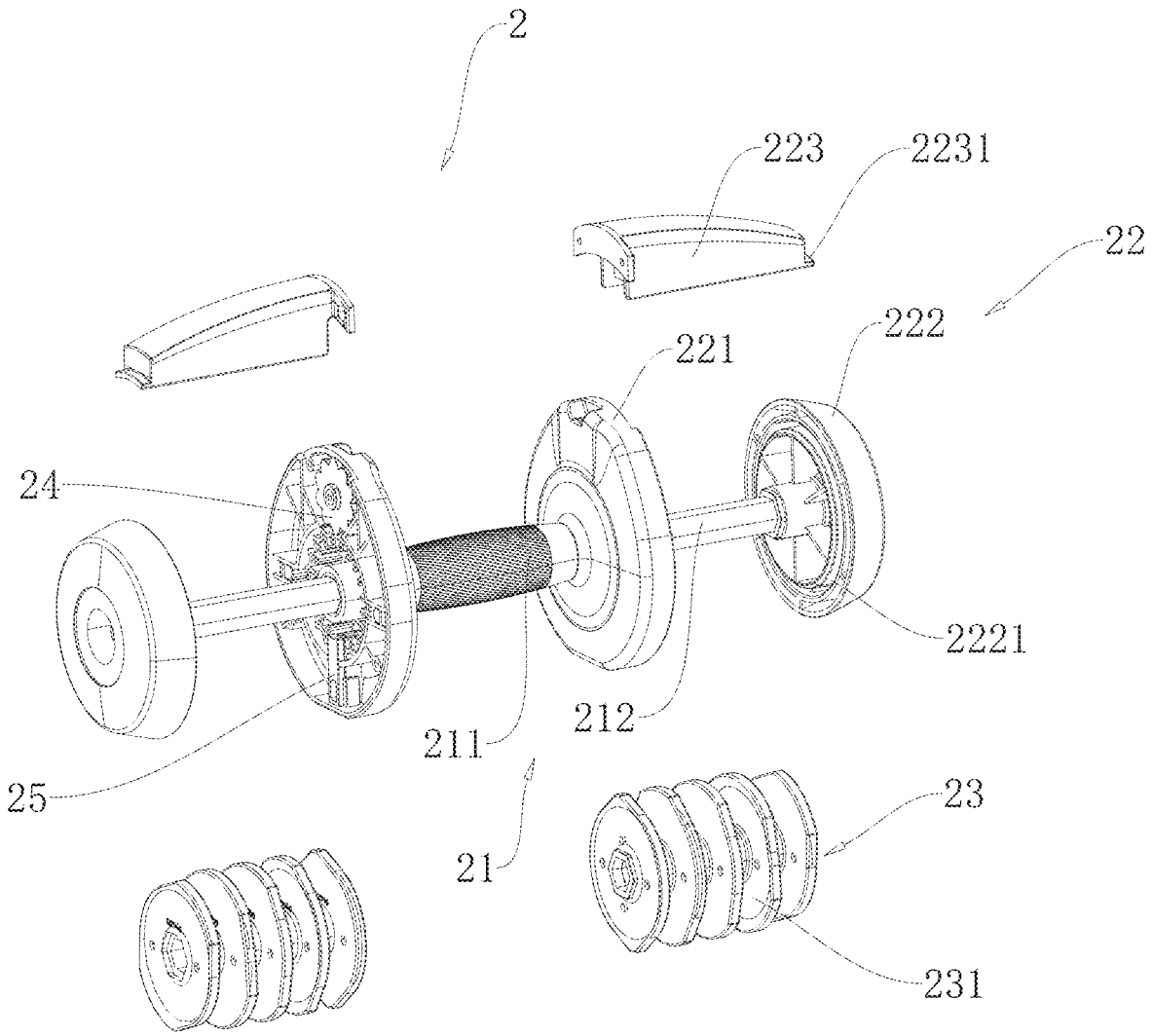
FIG. 3 is an exploded view of a grab handle assembly according to an embodiment of the present disclosure.

Referring to FIG. 2 and FIG. 3, the grab handle assembly 2 includes handle tube 21, end cover assembly 22, plate selection mechanism 23, display mechanism 24, and stop assembly 25. The handle tube 21 includes grip segment 211 configured for a hand of a user to be gripped, and mounting segment 212 penetrating through the grip segment 211 and having two ends symmetrically configured to mount a part. The mounting segment 212 has a hexagonal section, such that the part thereon is not prone to rotation. The end cover assembly 22 includes internal end cover 221 and external end cover 222. The external end cover 222 is provided at an end of the mounting segment 212 away from the grip segment 211 through a bolt. The external end cover 222 can rotate synchronously with the handle tube 21. The internal end cover 221 is rotatably provided at an end of the mounting segment 212 close to the grip segment 211.

The plate selection mechanism 23 is fixed on the mounting segment 212 in a sleeving manner, and located between the external end cover 222 and the internal end cover 221. The plate selection mechanism 23 includes fixing pieces 231 in one-to-one correspondence with the weight plates 11 and configured for the weight plates 11 to be mounted. A number of the fixing pieces 231 is the same as a number of the weight plates 11. Two ends of the handle tube 21 are respectively provided with five fixing pieces 231 and are symmetric, thereby realizing a weight balance.

Figure 4:
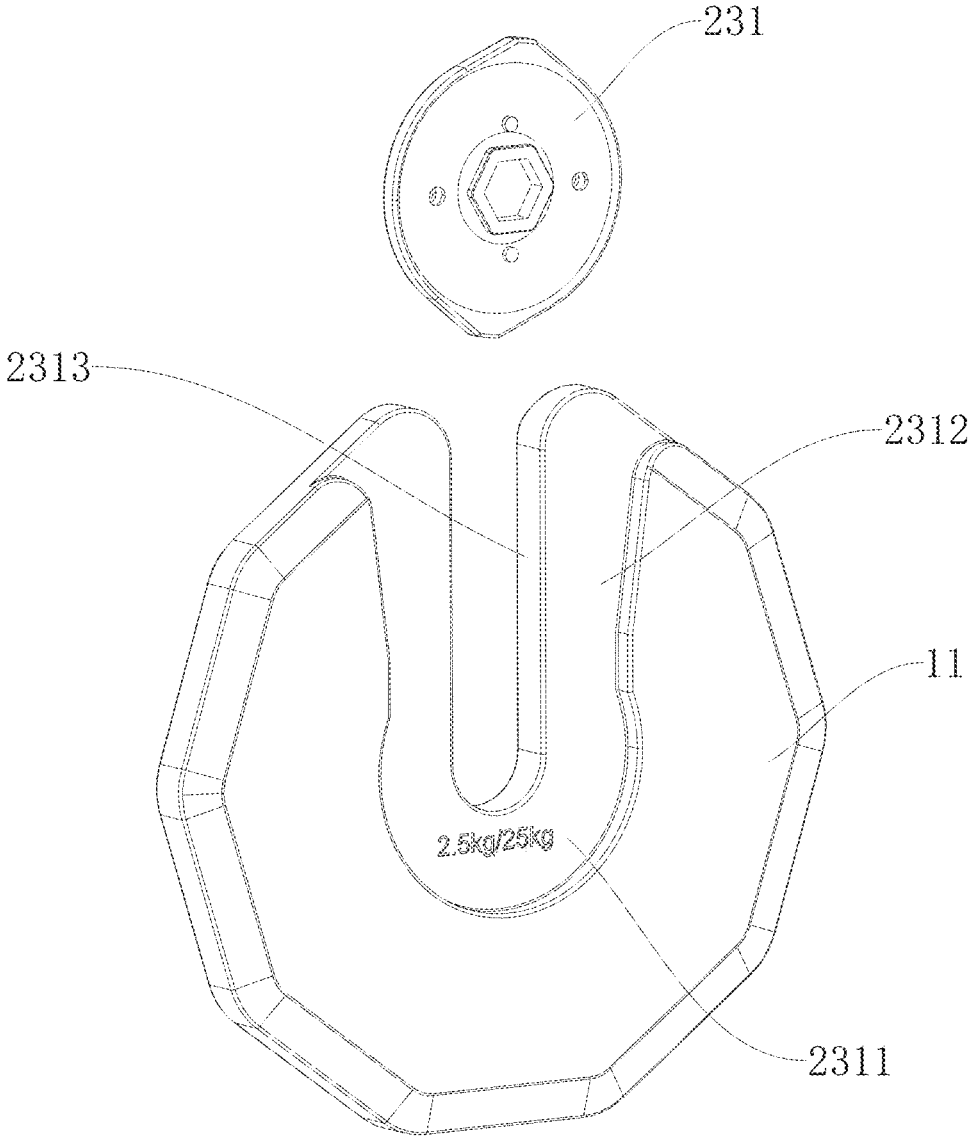
FIG. 4 is a schematic structural view of a fixing piece and a weight plate according to an embodiment of the present disclosure.

Referring to FIG. 4, each of the fixing pieces 231 is a centrosymmetric cam structure, and can be respectively rotatably clamped onto the weight plates 11. The weight plate 11 is a cylindrical thin sheet. Fixing groove 2311 configured for the fixing piece 231 to be clamped is formed at one end of the weight plate. Access groove 2312 penetrating into the fixing groove 2311 and configured for the fixing piece 231 to be vertically inserted into is further formed in the weight plate 11. The access groove 2312 is a rectangular groove. The fixing groove 2311 is a circular groove. A diameter of the fixing groove 2311 is greater than a width of the access groove 2312. A length of the fixing piece 231 is the same as the diameter of the fixing groove 2311. A width of the fixing piece 231 is slightly less than the width of the access groove 2312.

Adjacent fixing pieces 231 are misaligned, that is, the fixing piece has a misalignment angle with an axis of the handle tube 21 as a center. A difference between the length and the width of the fixing piece 231, the misalignment angle of the fixing piece 231 in a vertical state relative to a length direction, and a difference between the width of the fixing sheet 231 and the width of the access groove 2312 are associated, and satisfy (the length of the fixing piece 231—the width of the fixing piece 231)*sin $\theta \leq$(the width of the access groove 2312—the width of the fixing piece 231), $\theta$ being the misalignment angle of the fixing piece 231 in the vertical state relative to the length direction. The fixing piece 231 in a small inclination state can still completely slide into the fixing groove 2311 through the access groove 2312.

After the fixing piece 231 enters the fixing groove 2311 through the access groove 2312, the fixing piece 231 can be clamped into the fixing groove 2311 by rotating the fixing piece 231 for a certain angle. Meanwhile, due to the centrosymmetric fixing piece 231, the fixing piece 231 can be rotatably clamped, regardless of whether the fixing piece rotates clockwise or counterclockwise.

Referring to FIG. 3 and FIG. 4, anti-rotating clamping groove 2313 penetrating into the fixing groove 2311 is further formed in the weight plate 11. The anti-rotating clamping groove 2313 penetrates through two end surfaces of the weight plate 11 at the same time. Anti-rotating beam 223 is further connected between the external end cover 222 and the internal end cover 221. The anti-rotating beam 223 is strip-shaped, with a width matching with the width of the access groove 2312. The anti-rotating beam 223 is connected to a sidewall of the internal end cover 221 through a bolt. The anti-rotating beam 223 is slidably connected to the external end cover 222. A side of the anti-rotating beam 223 close to the external end cover 222 is provided with slider 2231. An annular sliding groove 2221 configured for the slider 2231 to be slidably provided is formed at a side of the external end cover 222 close to the anti-rotating beam 223. The width of the access groove 2312 is greater than a width of the mounting segment 212 of the handle tube 21. After the fixing piece 231 is vertically inserted into the weight plate 11, since both the mounting segment 212 and the anti-rotating beam 223 penetrate through the weight plate 11, the weight plate 11 provided on the fixing piece 231 is not prone to rotation in use. This prevents the weight plate 11 from falling off from the fixing piece 231 to hurt the user, and improves safety.

After the fixing piece 231, the mounting segment 212 and the anti-rotating beam 223 are inserted into the weight plate 11, the weight plate 11 is fixed relative to the anti-rotating beam 223, and the fixing piece 231 and the mounting segment 212 can rotate relative to the weight plate 11. By this time, an angle of the fixing piece 231 can be adjusted by rotting the handle tube 21.

The plate selection mechanism 23 is provided with a plurality of gears that are driven by the handle tube 21 to rotate relative to the weight plate sets 1. When the plate selection mechanism 23 rotates to different gears, different numbers of weight plates 11 can be fixedly suspended and gripped. In the embodiment, according to the number of weight plates 11, the plate selection mechanism 23 is provided with ten gears. A first gear is an initial condition in which there is no weight plate 11 but only a weight of the grab handle assembly 2. At a second gear, there is one small weight plate 11. At a third gear, there is one big weight plate 11. At a fourth gear, there are one small weight plate 11 and one big weight plate 11. At a fifth gear, there are two big weight plates 11. At a sixth gear, there are one small weight plate 11 and two big weight plates 11. At a seventh gear, there are three big weight plates 11. At an eighth gear, there are one small weight plate 11 and three big weight plates 11. At a ninth gear, there are four big weight plates 11. At a tenth gear, there are one small weight plate 11 and four big weight plates 11.

Figure 5:
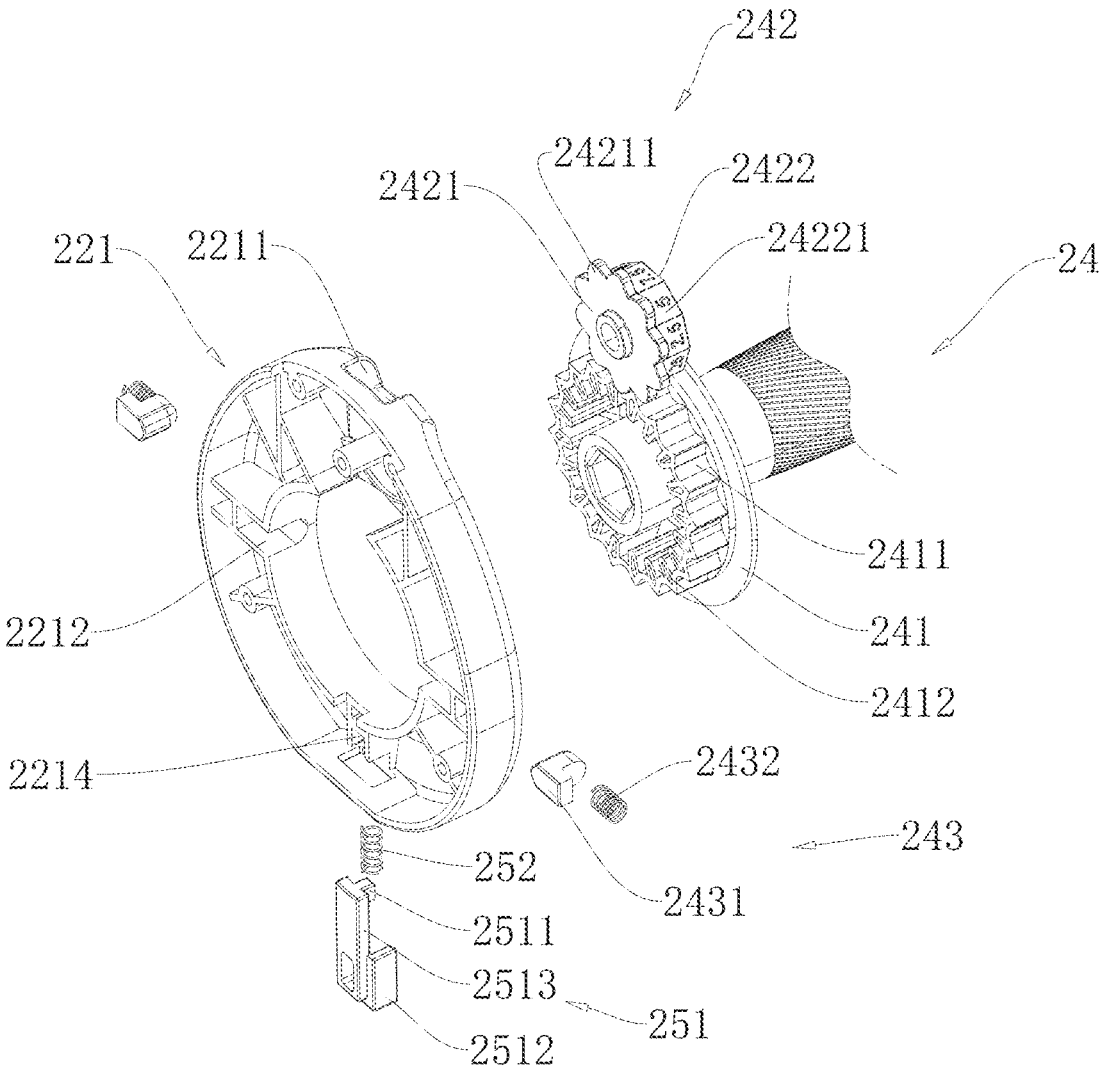
FIG. 5 is an exploded view of a display mechanism and an internal end cover according to an embodiment of the present disclosure.

Referring to FIG. 3 and FIG. 5, the display mechanism 24 is provided in the internal end cover 221, and includes locating disc 241, display disc 242, and locking assembly 243. The locating disc 241 is shaped as a circular disc, and integrally provided at two ends of the grip segment 211. Herein, the locating disc 241 may also be detachably connected to the grip segment 211. The locating disc 241 is located in the internal end cover 221. A plurality of locating recesses 2411 are uniformly formed in a circumferential direction of the locating disc 241. A number of the locating recesses 2411 doubles a number of the gears of the plate selection mechanism 23. Each of the locating recesses corresponds to one of the gears of the plate selection mechanism. The display disc 242 is horizontally and rotatably provided in the internal end cover 221, and located on the display disc 242. Rotating shaft 2213 is provided in the internal end cover 221. The display disc 242 is rotatably provided on the rotating shaft 2213. The display disc 242 includes toothed disc portion 2421 and display portion 2422. Driven toothed portion 24211 externally engaged with the locating recesses 2411 is provided in the circumferential direction of the toothed disc portion 2421. There are ten teeth on the driven toothed portion 24211. A number of the teeth on the driven toothed portion is the same as the number of the gears of the plate selection mechanism 23. The display portion 2422 has a decagonal vertical section. Labels 24221 in one-to-one correspondence with the gears of the plate selection mechanism 23 and configured to display a weight of the dumbbell at a present gear are provided in a circumferential direction of the display portion. A value on the weight of the dumbbell at the present gear is printed on the label 24221. Display opening 2211 penetrating through an inside and an outside of the internal end cover 221 is formed in a top of the internal end cover 221. When the dumbbell is located at some gear, the display opening 2211 can directly face the label 24221. By rotating the grip segment 211, the locating disc 241 can drive the display disc 242 to rotate synchronously. While the grip segment 211 rotates one circumference, both the plate selection mechanism 23 and the display portion 2422 rotate two circumferences.

When the dumbbell is used by the user, the gear is shifted by rotating the grip segment 211, thereby changing the number of weight plates 11 on the grab handle assembly 2. The label 24221 can change with rotation of the grip segment 211. A value on the label 24221 can be observed by the user through the display opening 2211 to know the weight of the dumbbell at the present gear.

There are two locking assemblies 243 that are symmetrically provided at two sides of the internal end cover 221. The locking assembly 243 includes clamping member 2431 and locking spring 2432. The clamping member 2431 is slidably provided on the internal end cover 221 and can cooperate with the locating recess 2411 of the locating disc 241 by clamping. Slideway 2212 configured for the clamping member 2431 to slide is formed in the internal end cover 221. The locking spring 2432 is provided in the slideway 2212, and includes one end abutting against the clamping member 2431, and the other end abutting against the slideway 2212. The clamping member 2431 driven by the locking spring 2432 can be always clamped into the locating recess 2411. When the gear is shifted, the clamping member 2431 can move from one locating recess 2411 to the adjacent locating recess 2411.

With the locking assembly 243, when the dumbbell is shifted to some gear in use, the locating disc 241 clamped by the clamping member 2431 is not prone to rotation. Meanwhile, when the gear of the dumbbell is not shifted in place, and the clamping member 2431 is located between two adjacent locating recesses 2411, the clamping member 2431 under an elasticity of the locking spring 2432 can drive the locating disc 241 to restore the gear, the clamping member 2431 is clamped at the gear adjacent to the locating disc 241, and the locating disc 241 is locked again. This reduces a probability that the weight plate 11 falls off to hurt the user because the gear of the dumbbell is not shifted in place in use of the dumbbell.

Figure 6:
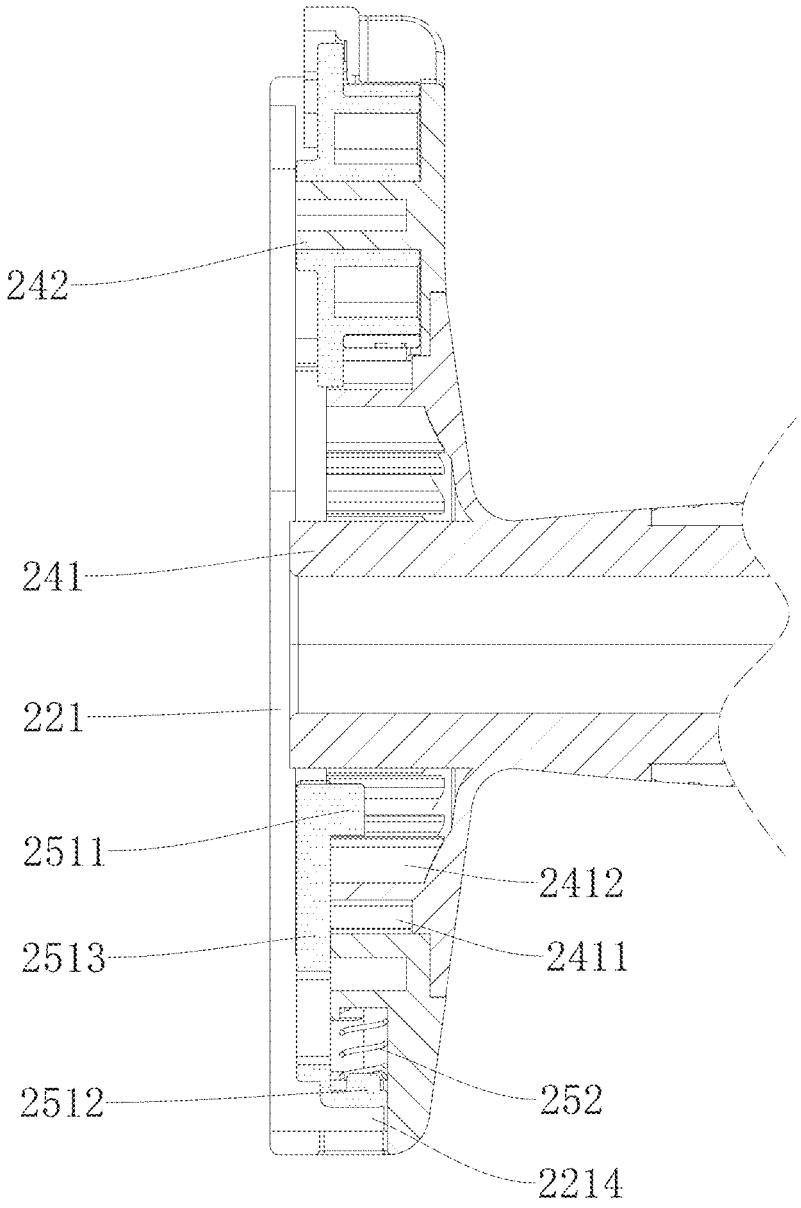
FIG. 6 is a sectional view in an internal end cover according to an embodiment of the present disclosure.

Referring to FIG. 5 and FIG. 6, the stop assembly 25 is provided in the internal end cover 221, and configured to lock rotation of the locating disc 241. The stop assembly 25 includes stop member 251 and stop spring 252. The stop member 251 is C-shaped, and includes locking member 2511, sliding member 2512, and connecting plate 2513 connected to the locking member 2511 and the sliding member 2512. Stop grooves 2412 configured to allow the locking member 2511 to be inserted into are formed in the circumferential direction of an inner race of the locating disc 241. The stop grooves 2412 are in one-to-one correspondence with the locating recesses 2411. Sliding groove 2214 configured for the sliding member 2512 to slide is formed in the internal end cover 221. The sliding groove 2214 is vertically formed, and penetrates to a peripheral surface of the internal end cover 221. The stop spring 252 is provided in the sliding groove 2214. The stop spring 252 includes one end abutting against the sliding member 2512, and the other end abutting against the sliding groove 2214. The stop spring 252 drives the locking member 2511 to always tend to be clamped into the stop groove 2412. When the gear of the dumbbell is shifted, the locking member 2511 driven by the stop spring 252 is clamped into the stop groove 2412, such that the grab handle assembly 2 is not prone to rotation after the dumbbell is lifted.

Referring to FIG. 2 and FIG. 6, placement groove 31 configured for the weight plate sets 1 and the internal end cover 221 to be placed is formed in the base 3. Limiting member 32 configured to be inserted into the internal end cover 221 and driving the stop assembly 25 to unlock is further provided on the base 3. When the weight plate sets 1 are placed into the placement groove 31, the fixing pieces 231 on the grab handle assembly 2 are vertically inserted into the weight plates 11. The limiting member 32 is inserted into the sliding groove 2214 of the internal end cover 221 and abuts against a bottom of the sliding member 2512. The sliding member 2512 driven by the limiting member 32 overcomes the elasticity of the stop spring 252 and slides vertically upward in the sliding groove 2214, such that the locking member 2511 falls out from the stop groove 2412, the grab handle assembly 2 can rotate, and the internal end cover 221 cannot rotate with the grab handle assembly 2. This can realize the gear shifting, change the number of weight plates 11 suspended and gripped on the grab handle assembly 2, and realize increase and decrease of the weight of the dumbbell.

With reference to FIG. 1 to FIG. 6, the weight-visualized dumbbell provided by the embodiment of the present disclosure has the following implementation principle: By rotating the grab handle assembly 2, the plate selection mechanism 23 can realize the gear shifting. The locating disc 241 in the display mechanism 24 is fixed with the grab handle assembly 2 to rotate. Since the display disc 242 is engaged with the locating disc 241, the display disc 242 can be driven by the locating disc 241 to rotate synchronously. The labels 24221 in one-to-one correspondence with the gears and each configured to display the weight of the dumbbell at the present gear are provided on the display disc 242. The label 24221 changes with the gear. Through the label 24221, the weight of the dumbbell at present can be known by the user.

The above are preferred embodiments of the present disclosure, but the protection scope of the present disclosure is not limited thereto. Therefore, all equivalent changes made in accordance with the structure, shape, and principle of the present disclosure shall fall within the protection scope of the present disclosure.

The invention claimed is:

1. A weight-visualized dumbbell, comprising two weight plate sets and a grab handle assembly configured to suspend and grip the two weight plate sets, wherein the grab handle assembly comprises a handle tube, an end cover assembly connected to the handle tube, and a plate selection mechanism connected to the handle tube and rotating synchronously with the handle tube; the plate selection mechanism is provided with a plurality of gears, wherein the plurality of gears are driven by the handle tube to rotate relative to the two weight plate sets; when the plate selection mechanism rotates to different gears of the plurality of gears, different numbers of the two weight plate sets are fixedly suspended and gripped; a display mechanism is provided in the end cover assembly; the display mechanism rotates synchronously with the handle tube; the display mechanism is provided with a plurality of labels, wherein the plurality of labels are in one-to-one correspondence with the plurality of gears of the plate selection mechanism and are each configured to display a weight of the weight-visualized dumbbell at a present gear; and a display opening configured for a label of the plurality of labels to be exposed is formed in the end cover assembly, wherein the display mechanism comprises a locating disc coaxial with the handle tube and configured to rotate synchronously with the handle tube, and a display disc provided on the end cover assembly and cooperating with the locating disc; a plurality of locating recesses are uniformly formed in a circumferential direction of the locating disc; a driven toothed portion cooperating with the plurality of locating recesses is provided in a circumferential direction of the display disc; each of the plurality of locating recesses corresponds to one gear of the plurality of gears of the plate selection mechanism; and the label is located on the display disc.

2. The weight-visualized dumbbell according to claim 1, wherein the display mechanism further comprises a locking assembly provided in the end cover assembly and cooperating with a locating recess of the plurality of locating recesses; and the locking assembly is configured to drive the plate selection mechanism to always tend to rotate to a gear of the plurality of gears.

3. The weight-visualized dumbbell according to claim 2, wherein the locking assembly comprises a clamping member slidably provided in the end cover assembly and a locking spring configured to drive the clamping member to always tend to be clamped into the locating recess.

4. The weight-visualized dumbbell according to claim 1, wherein the end cover assembly comprises an external end cover fixedly provided at an end of the handle tube and an internal end cover rotatably provided on the handle tube; the plate selection mechanism is located between the internal end cover and the external end cover; the display mechanism is provided in the internal end cover; and the display opening penetrates into the internal end cover from an outside of the internal end cover.

5. The weight-visualized dumbbell according to claim 4, wherein an anti-rotating beam is connected between the internal end cover and the external end cover; and an anti-rotating clamping groove configured for the anti-rotating beam to be clamped into is formed in each of the weight plates.

6. The weight-visualized dumbbell according to claim 1, wherein a number of the plurality of locating recesses doubles a number of the plurality of gears of the plate selection mechanism.

7. The weight-visualized dumbbell according to claim 1, further comprising a base configured for the two weight plate sets to be placed, wherein the base is provided with a limiting member; a stop mechanism is further movably provided in the end cover assembly; and the stop mechanism is configured to lock rotation of the locating disc or unlock the rotation of the locating disc through the limiting member.

8. The weight-visualized dumbbell according to claim 7, wherein stop grooves in one-to-one correspondence with the plurality of locating recesses are formed in the circumferential direction of the locating disc; and the stop mechanism comprises a stop member slidably provided in the end cover assembly and cooperating with the stop groove in a clamping manner, and a stop spring configured to drive the stop member to always tend to be clamped into the stop groove.

9. The weight-visualized dumbbell according to claim 1, wherein each of the plurality of gears is a centrosymmetric cam structure; a fixing groove configured for a given gear of the plurality of gears to be rotatably clamped is formed in each of the weight plates; and an access groove penetrating into the fixing groove and configured for the given gear to be vertically inserted into is further formed in each of the weight plates.

* * * * *